United States Patent [19]

Diemert

[11] Patent Number: 4,703,637

[45] Date of Patent: Nov. 3, 1987

[54] ELECTRIC LOCK WITH SPECIALLY SHAPED KEEPER, PARTICULARLY FOR THE DOOR TO A SECURED LOCALE

[75] Inventor: Jean-Marc Diemert, Selestat, France

[73] Assignee: Ritzenthaler S.A., Selestat, France; a part interest

[21] Appl. No.: 884,301

[22] Filed: Jul. 10, 1986

[51] Int. Cl.[4] ..... E05B 47/00

[52] U.S. Cl. ..... 70/277; 292/144

[58] Field of Search ..... 70/277, 281; 292/144, 292/193, 341.12, 341.13

[56] References Cited

U.S. PATENT DOCUMENTS

| | | | |
|---|---|---|---|
| 414,495 | 11/1889 | Conn | 292/193 |
| 1,486,595 | 3/1924 | Maruum | 292/193 |
| 3,636,745 | 1/1972 | Green | 70/281 |

FOREIGN PATENT DOCUMENTS

| | | |
|---|---|---|
| 0045225 | 2/1982 | European Pat. Off. . |
| 0077254 | 4/1983 | European Pat. Off. . |
| 94152 | 9/1897 | Fed. Rep. of Germany . |
| 2178250 | 11/1973 | France . |
| 2535773 | 5/1984 | France . |
| 557464 | 12/1974 | Switzerland . |

*Primary Examiner*—Robert L. Wolfe

*Attorney, Agent, or Firm*—Young & Thompson

[57] ABSTRACT

An electric lock comprises a bolt that is movable into and out of a specially-shaped keeper. The bolt is displaced relative to a casing by a motor that is in turn slidably mounted within the casing. During normal use, the motor is fixed relative to the casing by an electromagnetic, and urged away from the electromagnet by a spring that is weaker than the electromagnet. When the power supply to the lock is intentionally or unintentionally cut off, the spring thus urges the motor, and with it the bolt, away from the electromagnet, thereby automatically opening the lock.

7 Claims, 4 Drawing Figures

ELECTRIC LOCK WITH SPECIALLY SHAPED KEEPER, PARTICULARLY FOR THE DOOR TO A SECURED LOCALE

The present invention concerns the field of controlled access to a locale, particularly banks or the like equipped with doors or gates provided with locking devices controlled by means of electric or electronic devices, and has an an object an electric lock, particularly for the door to a secured locale.

At present, the security of such locales is generally ensured by means of doors equipped with keepers or electric locks controlled electrically or by an electronic apparatus authorizing or prohibiting entry. Such equipment may be mounted directly on ordinary existing doors, but there have similarly been envisioned assemblies which offer greater security and which comprise two doors controlled electrically such that they may not be opened simultaneously. These assemblies are known as "control gates".

These known devices require electrically controlled door locks and comprise electric locks or keepers, which however cannot be applied in a versatile manner, and which offer a security which may be insufficient. Moreover, their installation on existing doors is difficult if not impossible to effect.

The use of electric keepers entails certain disadvantages, namely, the surfaces of engagement of the bolt in the keeper are often too limited to effect a secure locking, these surfaces being still further limited in the case where the door sags. Moreover, such a keeper is auto-locking, such that it cannot be freed if a person pushes on the door simultaneously with delivery of the electric authorization. Finally, the doors equipped with these keepers require door closers able to develop great force, particularly in the case of especially heavy security doors, so as to assure a secure engagement of the bolt in the keeper upon closing, whereby manipulation of doors so equipped is inconvenient for children and the elderly.

The existing electric locks similarly have certain shortcomings which detract seriously from their ability to effect a secure closure. Specifically, either they are too bulky to be incorporated into a metallic door frame, or their mounting on existing doors is difficult if not impossible, or they are auto-locking. Moreover, because the security of locking is practically always effected by means of electromagnets, a door that is not completely closed, because of wind, door closers, small inclusions or slight deformations of the frame, is impossible to lock because the said electromagnets have a limited force and trajectory and thus cannot ensure simultaneously the completion of closure and the locking.

The present invention seeks to overcome these disadvantages.

Specifically, it has as an object an electric lock, particularly for a door to a secured locale, constituted by a motorized bolt provided with contacts limiting the trajectory of the bolt or bolts and by a keeper, the lock being characterized in that the keeper comprises an introduction cone for completing the closure of the door and a deep closure extending the said cone and ensuring the ultimate locking, and in that the movable bolt is displaced in a compact block in which a motor with associated reduction gear is slidably mounted by means of a guiding means, which motor is secured in work position by an electromagnet against the action of an adjustment spring fixed on the motor by means of a shaft and fixed on the block through the intermediary of a shaft, this adjustment spring conducting the motor together with the bolt, out of the introduction and locking regions of the keeper at the time of a deenergization of the electromagnet.

The invention will be best understood thanks to the following description, which relates to a preferred embodiment given by way of non-limiting example, and explained with reference to the accompanying schematic drawings, in which.

Figure 1:
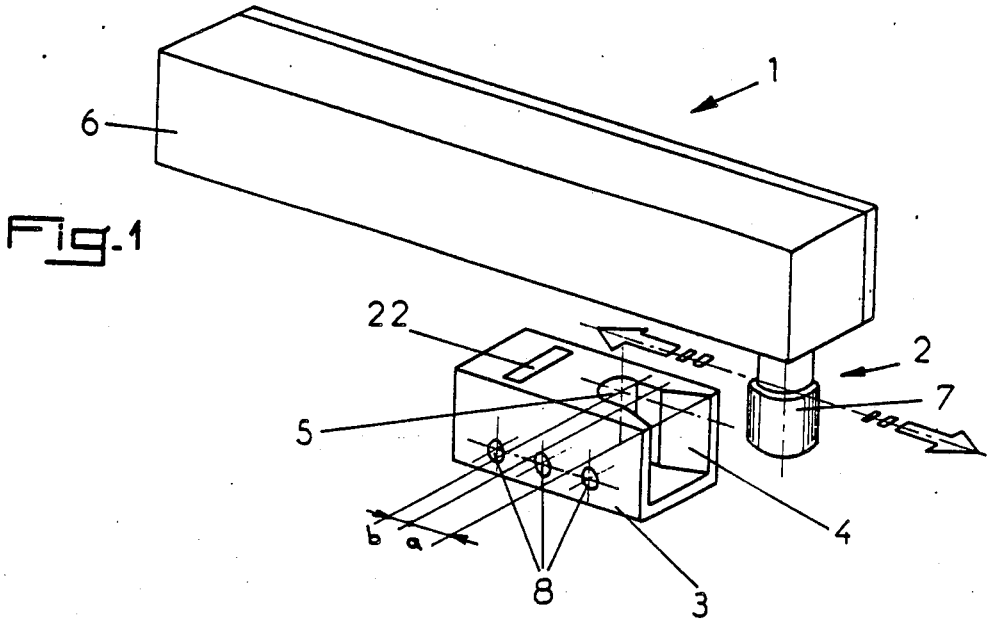
FIG. 1 is a perspective view of the lock according to the invention.

According to the invention, and as is shown more particularly by way of example in FIG. 1 of the accompanying drawings, the electric lock especially for a door to a secured locale, is essentially constituted by a compact block 1 which comprises a motorized, movable bolt 2 and which may be mounted on the upper cross-piece of an existing door frame and by an over-dimensioned keeper 3, intended to be mounted on the opening portion of the door and which comprises an introduction cone 4 permitting the completion of the closing and a deep catch 5 which extends the said cone and ensures the ultimate locking of the door.

The compact block 1 is provided with protective cover 6 provided with a through opening (not shown) for the shaft of the bolt 2, which is movable in horizontal translation, and which has the form of an enlarged finger beneath the block 1, the free extremity of which is provided with a roller 7 mounted on bearings. This embodiment of the bolt 2 allows facilitating its displacement, even under a strong thrust.

The introduction cone 4 and the deep catch 5 of the keeper 3 extend respectively along the length regions a and b of the keeper 3, which is moreover provided with holes 8 for fixation on the opening portion of the door.

Figure 2:
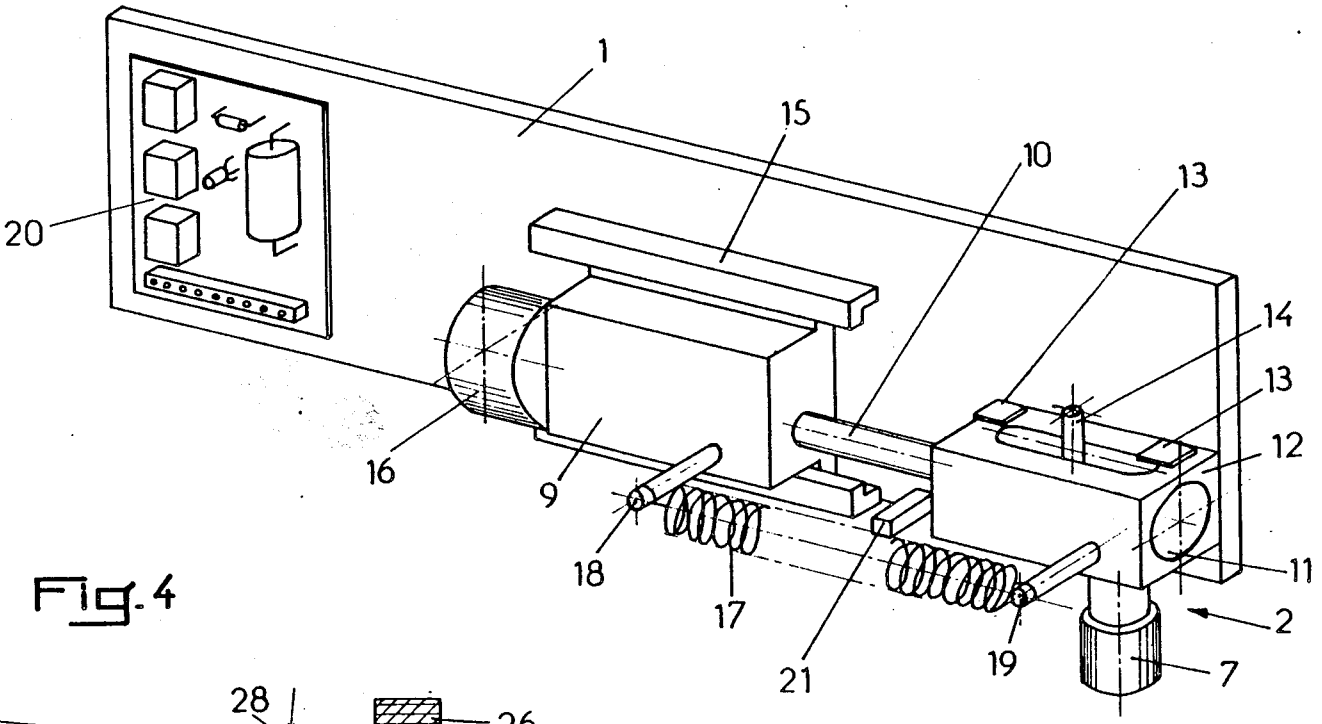
FIG. 2 is a detail of the compact block comprising the bolt.

The actuation of the bolt 2 is effected by means of a motor (with associated reduction gear) 9 acting, through the intermediary of a threaded bolt 10, on a shaft 11 fixed to the bolt 2 and guided in translation through a bearing block 12, the course of the bolt being regulated by means of delimiting projections 13 mounted on the bearing block 12 and cooperating with a pin 14 fixed to the shaft 11 (FIG. 2). This motor 9 assures the completion of closing of the door by introduction of the roller 7 of the bolt 2 on the length region a of the cone 4 of the keeper 3, then the ultimate locking in the length region b of the deep catch 5.

The motor 9 is slidably mounted on the block 1 by means of a guide 15 and is secured in work position by an electromagnet 16 against the action of a compression spring 17 fixed on the motor 9 by means of a shaft 18 and fixed on the block 1 through the intermediary of a shaft 19, this compression spring 17 conducting the motor 9, together with the bolt 2, out of the introduction a and locking b regions of the keeper 3 at the time of a deenergization of the electromagnet 16.

Specifically, when such a deenergization of the electromagnet 16 occurs, this latter frees the motor 9, which is displaced, together with the bolt 2 in unlocked position. This embodiment especially permits freeing the door almost instantaneously according to the fire safety rules.

The control of the motor 9 is effected by an electronic management circuit 20 mounted in the block 1 and actuated by a flexible leaf interrupter 21, similarly mounted in the block 1, which cooperates in position of completion of closure and locking with a magnet 22 mounted on the keeper 3. Thus, in the previously-described position, the magnet 22 attracts the leaf of the interrupter 21, the contact of which is then closed, and which actuates the electronic management circuit 20, which delivers a control pulse to the motor 9 in the direction of a closure and locking of the door.

Figure 3:
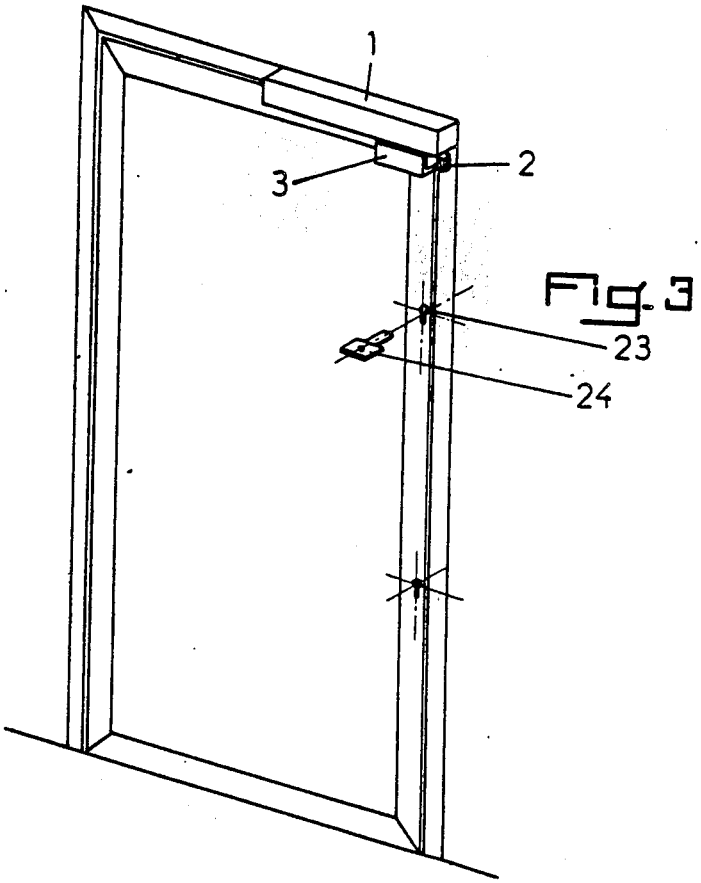
FIG. 3 is a perspective view of a door equipped with a lock according to the invention.

Accordingly to another characteristic of the invention, and as is shown in FIG. 3, the electric supply circuit of the electromagnet 16 for maintaining the motor 9 in work position is branched in series with the electric contacts of a cylinder 23 with a normally closed incorporated contact, the opening of which may be effected by the introduction and rotation of a key 24. Thus, the introduction of the key 24 in the cylinder 23 results in deenergizing the electromagnet 16, such that the motor 9 and the bolt 2 are conducted to the unlocked position.

Figure 4:
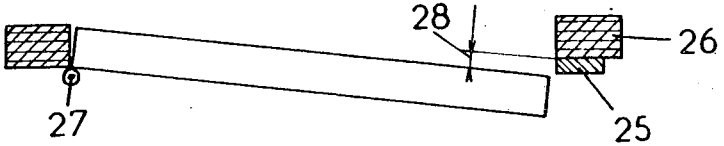
FIG. 4 is a sectional view from above of the door.

According to another characteristic of the invention, and as is shown in FIG. 4, the lock is combined with a vertical strip 25 fixed on the frame piece 26 of the door on the side opposite the hinges 27 and extending over the entire height of the said frame, the thickness of this strip 25 being at least equal to the space 28 corresponding to the opening starting from when the said roller 7 of the bolt 2 is disengaged in the cone 4 of the keeper 3.

This strip 25 thus permits totally closing the space 28, such that it is impossible to insert one's fingers therein, even the fingers of children, and serious injuries are thus prevented at the time of closing by the electric lock. Thanks to the invention, it is possible to realize electric locks for the door to a secured locale offering complete safety of operation and permitting a completion of the closing as well as an ultimate locking.

It will be understood that the invention is not limited to the embodiment described and shown in the accompanying drawings. Modifications remain possible, particularly from the point of view of the construction of the various elements, or by a substitution of equivalent techniques, without departing whatsoever from the scope of protection of the invention.

I claim:

1. In an electric lock comprising bolt means and a keeper; said bolt means comprising a casing adapted to be fixed to a door frame, a bolt member projecting from said casing, and motor means for displacing said bolt member relative to said motor means along and opposite a first direction; said keeper having a recess and being adapted to be fixed to a door such that said recess extends along said first direction, said recess having an outwardly flared opening substantially wider than said bolt member in a second direction perpendicular to said first direction; the improvement in which said motor means is slidably mounted in said casing for sliding movement along said first direction, and said casing further comprises an electromagnet adapted to maintain said motor means in a fixed position relative to said casing and spring means urging said motor means and hence said bolt member to slide along said first direction from said fixed position away from said electromagnet, said electromagnet exerting on said motor means a force greater than said spring means.

2. Lock according to claim 1, wherein said bolt member comprises an end remote from said casing having a roller adapted to rotate about an axis extending in a third direction perpendicular to said first and second directions, said roller adapted to be received in said recess of said keeper.

3. Lock according to claim 1, wherein said motor means comprises a threaded output shaft in threaded engagement with said bolt member.

4. Lock according to claim 1, wherein said bolt member is slidably mounted in a bearing block fixed in said casing, said bearing block having an opening through which a pin of said bolt member projects, said opening extending along said first direction, said pin and said opening cooperating to define a path of said bolt member between locked and unlocked positions along said first direction.

5. Lock according to claim 1, and an electronic control circuit mounted in said casing, a flexible leaf contact mounted on said casing, and a magnet mounted on said keeper, said contact and said magnet being adapted to contact one another upon closure of said door relative to its said frame, said electronic control circuit operating said motor means responsive to contact of said flexible leaf contact with said magnet.

6. Lock according to claim 1, and a key cylinder adapted to receive a key, said key cylinder being adapted to de-energize said electromagnet responsive to introduction and rotation of a said key in said key cylinder.

7. Lock according to claim 1, and a strip adapted to be affixed to a said door frame, said strip having a thickness corresponding to the extent to which said outwardly flared opening of said keeper recess is wider than said bolt member is said second direction.

* * * * *